United States Patent [19]

Klein et al.

[11] 4,013,175

[45] Mar. 22, 1977

[54] DEVICE FOR CONTROLLING THE RETURN OF A CENTRAL COUPLING FOR RAIL VEHICLES TO ITS CENTRAL POSITION

[75] Inventors: Willi Klein, Remscheid; Henning Rocholl, Radevormwald; Reinhard Naydowski, Remscheid, all of Germany

[73] Assignee: Bergische Stahl-Industrie, Remscheid, Germany

[22] Filed: Sept. 23, 1975

[21] Appl. No.: 615,843

[30] Foreign Application Priority Data

Sept. 24, 1974 Germany ..... 2445460

[52] U.S. Cl. ..... 213/20

[51] Int. Cl.[2] ..... B61G 7/12

[58] Field of Search ..... 213/19, 20, 21, 60, 213/61

[56] References Cited

UNITED STATES PATENTS

| | | | |
|---|---|---|---|
| 2,754,978 | 7/1956 | Metzger | 213/20 |
| 3,481,491 | 12/1969 | Cope | 213/20 |
| 3,926,317 | 12/1975 | Scharfenberg et al. | 213/20 |

*Primary Examiner*—Stanley H. Tollberg
*Assistant Examiner*—Hadd Lane
*Attorney, Agent, or Firm*—Walter Becker

[57] ABSTRACT

A device for controlling the return of the coupling head for central couplings to their central position, especially for use in connection with rail vehicles, in which the coupling head is by means of a coupling rod linked to a housing arranged on a vehicle. A cam operatively connected to the coupling rod extends between two abutments which in the horizontal path of the cam are displaceable hydraulically, electrically or pneumatically. In one end position of the abutments, the full horizontal lateral deviation of the coupling rod is available, whereas in the other end position, the cam is clamped in between the two abutments.

15 Claims, 3 Drawing Figures

DEVICE FOR CONTROLLING THE RETURN OF A CENTRAL COUPLING FOR RAIL VEHICLES TO ITS CENTRAL POSITION

The present invention relates to a device for a controllable central return in the horizontal plane of the coupling heads for middle couplings, especially for automatically connecting individual rail vehicles, while the coupling head with a coupling rod is in a housing arranged on the vehicle pivotally linked in a horizontal plane.

With the introduction of the middle or central buffer couplings with rail vehicles, the problem occurred so to place the coupling head in its middle or central position, and more specifically in the horizontal and vertical planes, that each head of the two vehicles to be coupled together is located within the gripping range so that when the two vehicles move together, the two couplings can automatically couple to each other.

To this end, first expensive spring constructions were employed, which had, above all, the drawback that the space laterally and below the coupling rod had to be occupied by the springs. Therefore, a linkage system was developed according to which the function of the central return in all planes in which the linkage housing to be connected to the vehicle could be combined. The drawback, however, consisted in the fact that due to the coupling heads ever becoming heavier and heavier, it was necessary to employ ever stronger return spring elements so that the manual manipulation, especially when coupling in a curve became more and more difficult.

Therefore, it has been suggested to effect the return position, especially in a horizontal plane, only within a certain angle range. However, this improved construction had the drawback that when driving a non-coupled coupling, vibration oscillations and movements about the point of rest could not be avoided so that in such an instance, a particular arresting system of the non-used coupling had to be provided which, in turn, increased the cost of the coupling.

It is, therefore, an object of the present invention so to improve a linkage system for middle and middle buffer couplings that when driving with non-used couplings, the latter will firmly remain in its intermediate position, while on the other hand, this blocking in the intermediate position could be realized without having to employ excessive pivoting forces.

It is another object of this invention to provide an invention as set forth in the preceding paragraph which can be produced at a reduced cost over heretofore known similar devices while taking full advantage of the possibilities now available with rail vehicles.

This object and other objects and advantages of the invention will appear more clearly from the following specification, in connection with the accompanying drawings, in which.

The device according to the present invention is characterized primarily in that a cam operatively connected with the coupling rod extends between two abutments which, along in the horizontal path of the cam, are arranged to be displaced pneumatically, hydraulically, or electrically, while in one end position of the abutments, the full horizontal lateral deflection of the coupling rod will be available, whereas in the other end position the cam will be clamped in between the two abutments.

Expediently, the cam is arranged on the dish which is directly, or by means of a frictionally engaging rubber cushion, connected to the coupling rod.

Advantageously, the abutments are arranged on one lever each, which in their turn, are linked to the linkage housing and through the intervention of intermediate levers are arranged on the actuating cylinder.

Figure 1:
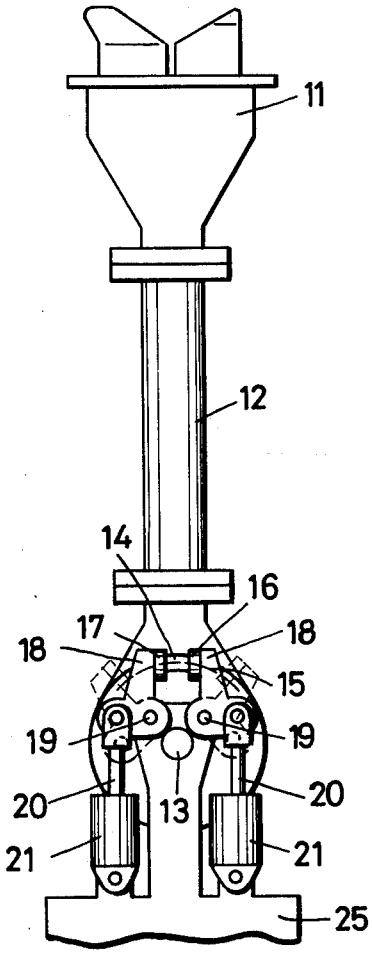
FIG. 1 is a diagrammatic illustration of the device according to the invention.

Referring now to the drawings in detail, as will be seen from FIG. 1, the coupling head 11 which does not have to be of a certain definite system is, through the intervention of the coupling rod 12, universally linked to a vertical bolt 13 in such a way that there will be possible not only tilting movements in the horizontal plane, but also in the vertical plane and there will also be possible tilting movements for tilting about the longitudinal axis of the coupling rod. The return devices in the vertical plane and for the pivoting movement are not illustrated because these are conventional devices. For the return in a horizontal plane, a cam 14 pointing upwardly is arranged at the rear end of the coupling rod. This cam 14 will when deviating laterally describe the path 15. In this path 15 of cam 14 there are displaceably arranged two abutments 16 and 17 while the abutments 16, 17 are respectively connected to one but a different lever 18 each. The levers 18 are on one hand by means of axles 19 directly or through the housing 25 pivotally linked in a horizontal plane to the vehicle, and on the other hand are arranged by means of the piston rod 20 to actuating means 21 respectively pertaining to the levers 18.

The cylinder piston means 21 acting as actuating means are single acting, and the pistons thereof when being acted upon by compressed air occupy the position shown in FIG. 1 whereby the levers 18 are moved into the position shown in full lines. In this position, the levers 18 by means of the abutments 16 and 17 clamp the cam 14 therebetween so that the coupling rod 12 and thereby the coupling head 11 are placed into their central position. In this position, the coupling head can hardly carry out movements about a vertical axis and thus stays in a substantially fixed position.

If, however, the pressure is released from the cylinder-piston system 21, a return spring, known per se, and arranged in each cylinder will see to it that the piston and therefore the piston rod 20, is displaced downwardly. As a result thereof, the levers 18 are moved into the dash-like position in which the abutments 16 and 17 still are located in the parts 15 and act as end abutments for the lateral deviation of the coupling rod.

Figure 2:
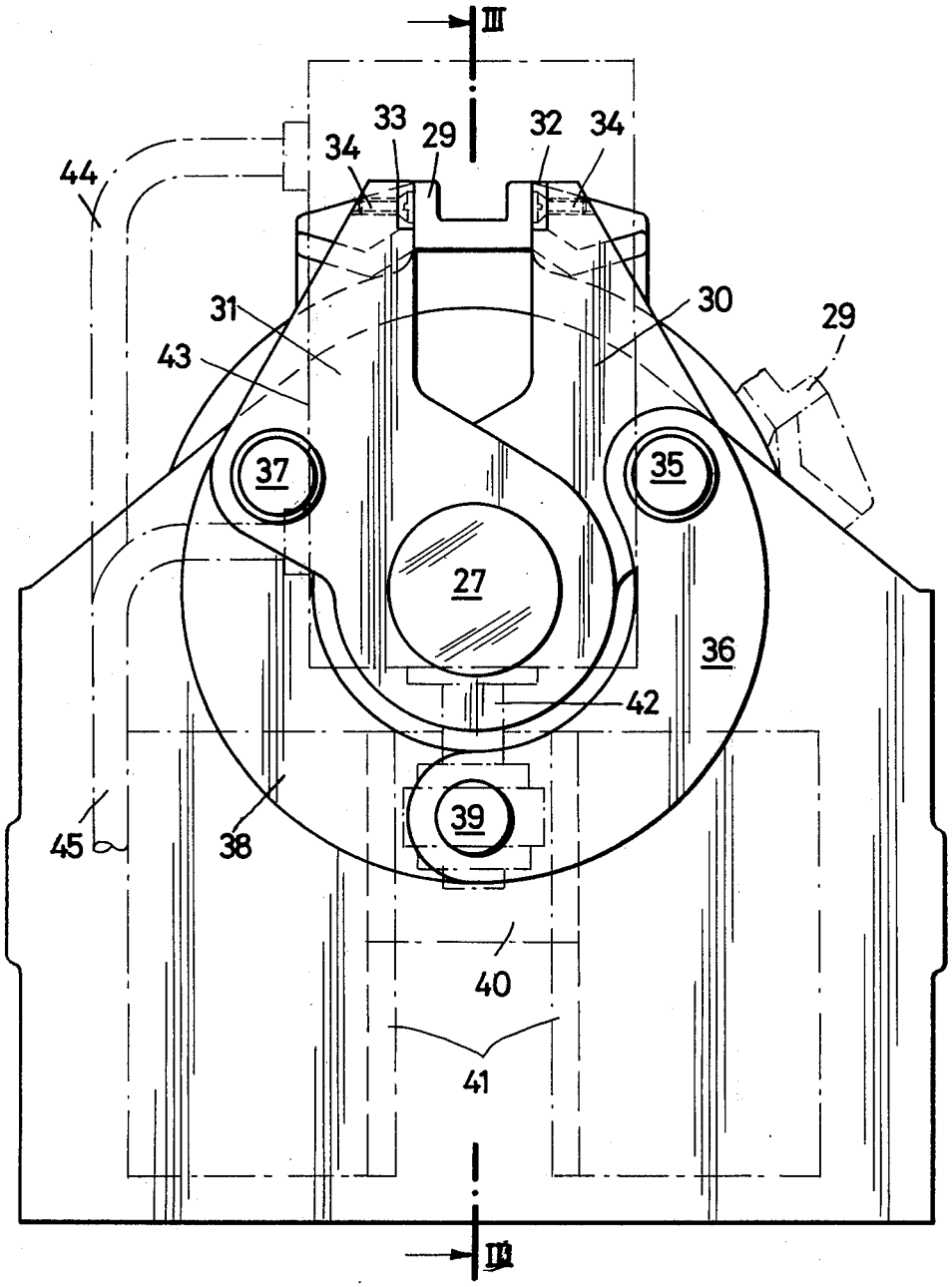
FIG. 2 is a diagrammatic illustration of a top view of a linkage housing according to the invention.
Figure 3:
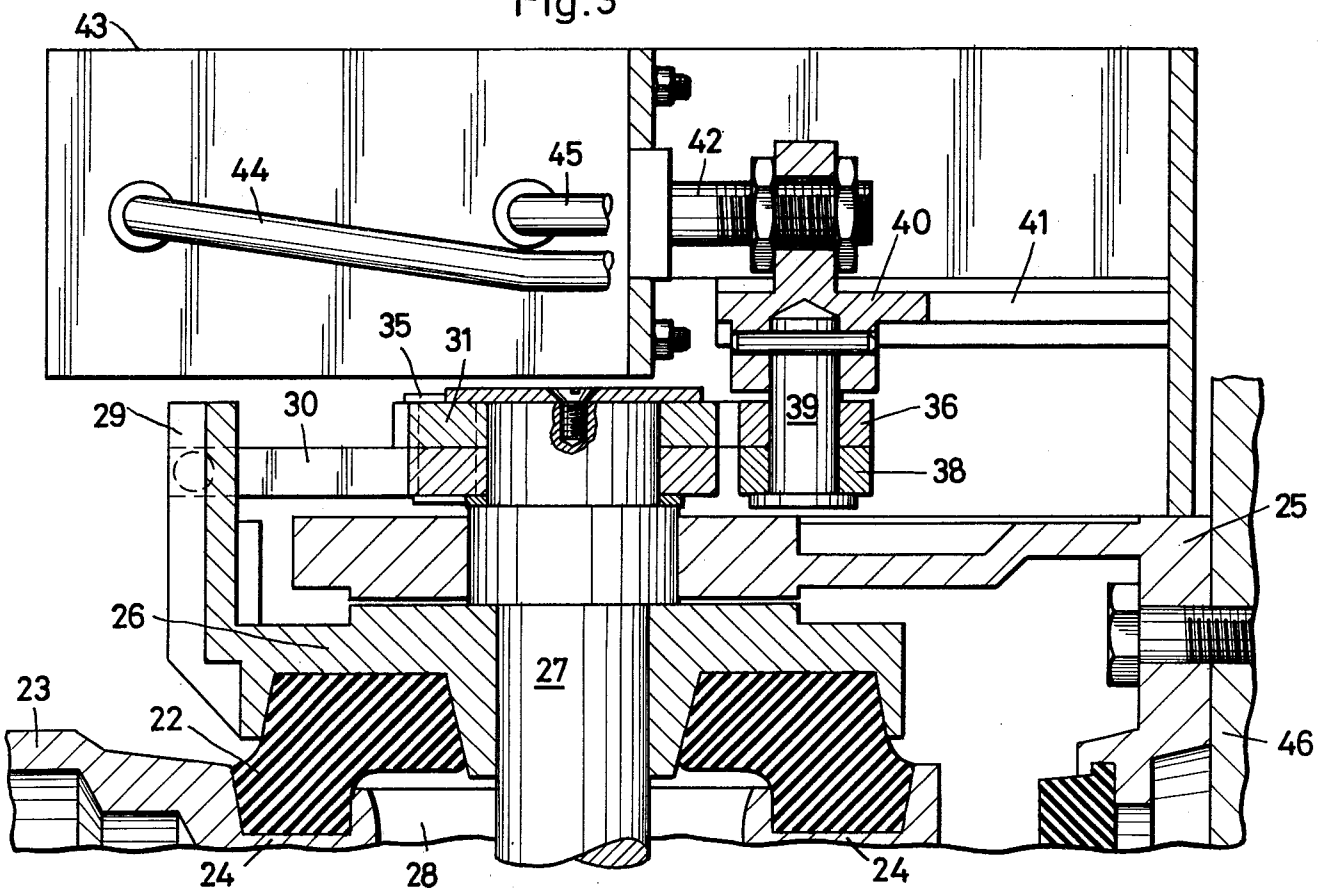
FIG. 3 is a section taken along the line III-III of FIG. 2.

According to FIGS. 2 and 3, the device according to the invention is employed in connection with a linkage system according to which the return in the vertical plane and the pivoting about the longitudinal axis of rubber cushions under pressure is carried out while the rubber cushions 22 (FIG. 3 shows the upper one only) are clampled in between a dish 24 provided at the end of the coupling rod 23 and a dish 26. As a result thereof, between the dish 24 on one hand, and the dish 26 on the other hand, and the respective engaging surfaces of the rubber cushion 22, frictional engagement is established. The dishes 26 are centered by the bolt 27 arranged vertically in the housing 25. However, the opening 28 in dish 24 is so great that a longitudinal movement of the coupling rod 23 will be possible and that the wall of the opening 28 will engage bolt 27 only when the pull or pressure force on the coupling rod is too high. At the dish 26 which through friction of the rubber cushion 22 is connected to the coupling rod 23, there is provided a cam 29 which extends through housing 25 in upward direction. Cam 29, however, will during a lateral deviation of the coupling rod 23 describe a circular path around the center of the bolt 27.

On that end of bolt 27 which projects beyond the housing 25 there are rotatably arranged two levers 30 and 31 which at their front end carry the abutments 32 and 33. The abutments 32 and 33 may, by means of screws 34, be adjustable and are located in the path of cam 29. On lever 30 with bolt 35 there is linked an intermediate lever 36, and below the lever 31 there is linked to the bolt 37 an intermediate lever 38. Both levers 36 and 38 are, by means of a common vertical bolt 39, linked to a sliding member 40 of a sliding guide 41 which extends parallel to the coupling rod. This sliding member 40 is, in its turn, connected to the piston rod 42 of a fluid-operable cylinder 43 in a manner known per se. The actuating cylinder 43 has two pressure conduits 44 and 45 and is advantageously directly connected to the linkage housing 25 which, in its turn, is connected to the vehicle or its frame 46.

In this instance, a double acting cylinder-piston system 43 is employed as actuating means while the two end positions have adjustable cushioning means so that during the return of the coupling no damage can be done by the relatively high mass forces. With a cylinder of this type, by introducing pressure into conduit 44, the middle position can be eliminated because in such an instance the piston of the cylinder presses the piston rod 42 downwardly (with regard to the drawing) whereby the slide member 40 is in the slide guide likewise displaced in downward direction while taking along the two levers 36 and 38. In this connection, the two levers 30 and 31 are pivoted about the bolt 27 whereby the abutments 32 and 33 are pivoted back. In pivoted back position of the abutments 32 and 33, these abutments are still located in the path of cam 29 so that these abutments may also serve as limitation for the lateral deviation of the coupling rod. However, it is also possible to employ other abutments.

For carrying out a coupling action, in such an instance, advantageously a valve is actuated preferably from the driver's stand, by which pressure is conveyed into the conduit 45 so that the piston rod 42 moves the slide member 40 and thereby the intermediate levers 36 and 38 into the position illustrated in FIG. 2. In this way, the levers 30 and 31 have likewise been brought into the illustrated position, while, for instance, with a left-hand lateral deviation of the coupling rod, first abutment 33 has hit the cam 29 and has carried the same along and pivoted (thereby also the coupling rod or coupling) until cam 29 also engages the abutment 32. If this happens, the coupling rod is again set to its central position and occupies the position illustrated in FIG. 2. The piston with the piston rod 42 of the actuating cylinder-piston system 43 will then occupy its upper end position. In order in this connection to bridge wear, the abutments 32 and 33 are adjustable and by means of screws 34 may be set in the direction toward the cam 29 until the latter is firmly clampled between the two abutments.

The abutments 32 and 33 are made of a shock-absorbing material inasmuch as in particular in uncoupled condition of the coupling are exposed to shock stresses. A suitable shock-absorbing material in this connection is rubber or a suitable synthetic material.

As has been mentioned above, advantageously for the actuation of the middle return mechanism single acting or double acting cylinder-piston systems may be employed while the double acting cylinder-piston systems have some advantages which make it preferable to employ double acting cylinder-piston systems. In particular, the control of the double acting cylinder-piston systems offer some advantages with regard to safety. Thus, for instance, an additional pressure switch may be installed in the coupling surface of the coupling head, which switch will assure that in coupled condition the actuating cylinder-piston system cannot be turned on because in such instance the lateral movability of the coupling head would be in turned-off condition. Moreover, it may be expedient to provide limit switches at the sliding guide so that also here sufficient safety would be assured.

Instead of the cam, also other elements may be directly provided on the coupling rod or on other parts operatively connected thereto. Under some circumstances, it is also important to design this cam itself resilient, in order to make sure that during the middle return by the abutments, not too hard shocks are exerted upon the coupling, which shocks might otherwise cause damage. Instead of a hydraulic or pneumatic cylinder-piston system, also electric actuating means may be employed, as, for instance, a solenoid, or a linear motor.

As will be evident from the above, the advantage of the device according to the invention is seen primarily in the fact that the returning force is no longer permanently effective, but may be turned on only when needed and that in particular when the coupling is in non-use condition, the head with the coupling rod cannot carry out oscillations or vibrations in the horizontal plane. Such vibrations or oscillations are undesired and under certain circumstances may cause damage. Furthermore, with the arrangement according to the invention, the middle return is possible from the driver's stand of a vehicle when the corresponding control lines are provided. Also, automatically acting safety means may be provided which cause the middle return always to become effective when the pertaining coupling head is not uncoupled. Moreover, it is important that as driving means for the middle return it is possible to employ the pneumatic, hydraulic or electric network which is present in every rail vehicle.

It is, of course, to be understood that the present invention is, by no means, limited to the specific showing in the drawings, but also comprises any modifications within the scope of the appended claims.

What we claim is:

1. A device for adjustably returning to central position in a horizontal plane the coupling head of central couplings, especially for automatically connecting individual rail vehicles, which includes in combination: a coupling rod, housing means for mounting on a vehicle to be coupled, said coupling head being pivotally connected to said housing means through the intervention of said coupling rod, cam means movable in a horizontal plane and operatively connected to said coupling rod, two adjustable abutment means respectively arranged on opposite sides of said cam means for cooperation therewith, and power operable means operatively connected to said abutment means and operable to move said abutment means along said horizontal plane from a first position corresponding to the central horizontal position of said coupling rod in which said cam means is clampled in between said abutment means to a second position in which said coupling rod occupies the position of its maximum lateral horizontal deviation from said first and thereby said central position, and vice versa, dish-shaped means having said cam means arranged thereon and being directly connected to said coupling rod, and a cushion of rubber material, said cam means being arranged on said dish-shaped means, and said dish-shaped means being frictionally connected to said coupling rod through said cushion, a sliding member and guiding means for guiding said sliding member, one end of said intermediate lever means being pivotally connected to said sliding member, and said sliding member being rigidly connected to said piston rod.

2. A device in combination according to claim 1, which includes two levers respectively supporting said abutment means and pivotably connected to said housing means.

3. A device in combination according to claim 2, which includes intermediate lever means, and in which said power operable means comprises a cylinder-piston system having a piston rod connected to said intermediate lever means, said intermediate lever means being linked to said levers supporting said supporting said abutment means.

4. A device for adjustably returning in a horizontal plane the coupling head of central couplings, especially for automatically connecting individual rail vehicles, which includes: a coupling rod, housing means for mounting on a vehicle to be coupled, said coupling head being pivotally connected to said housing means through the intervention of said coupling rod, cam means movable in a horizontal plane and operatively connected to said coupling rod, two adjustable abutment means respectively arranged on opposite sides of said cam means for cooperation therewith, and power operable means operatively connected to said abutment means and operable to move said abutments means along said horizontal plane from a first position corresponding to the central horizontal position of said coupling rod in which said cam means is clamped in between said abutment means to a second position in which said coupling rod occupies the position of its maximum lateral horizontal deviation from said first and thereby said central position, and vice versa, two levers respectively supporting said abutment means and pivotally connected to said housing means, intermediate lever means, said power operable means comprising a cylinder-piston system having a piston rod connected to said intermediate lever means, said intermediate lever means being linked to said levers supporting said abutment means, a sliding member and guiding means for guiding said sliding member, one end of said intermediate lever means being pivotally connected to said sliding member, and said sliding member being rigidly connected to said piston rod.

5. A device according to claim 4, in which said power operable means are common to both of said abutment means for actuating same.

6. A device according to claim 4, which includes dish-shaped means having said cam means arranged thereon and being directly connected to said coupling rod.

7. A device according to claim 4, which includes dish-shaped means and a cushion of rubber material, said cam means being arranged

8. A device according to claim 4, which includes bolt means arranged in said housing and having an extension pivotally supporting said levers.

9. A device according to claim 4, in which said cylinder-piston system has a single acting piston for the forward stroke and a return spring for the return stroke to return said piston to its rest position while said abutment means occupy their fully opened position.

10. A device for adjustably returning in a horizontal plane the coupling head of central couplings, especially for automatically connecting individual rail vehicles, which includes: a coupling rod, housing means for mounting on a vehicle to be coupled, said coupling head being pivotally connected to said housing means through the intervention of said coupling rod, cam means movable in a horizontal plane and operatively connected to said coupling rod, two adjustable abutment means respectively arranged on opposite sides of said cam means for cooperation therewith, and power operable means operatively connected to said abutment means and operable to move said abutment means along said horizontal plane from a first position corresponding to the central horizontal position of said coupling rod in which said cam means is clamped in between said abutment means to a second position in which said coupling rod occupies the position of its maximum lateral horizontal deviation from said first and thereby said central position, and vice versa, two levers respectively supporting said abutment means and pivotally connected to said housing means, intermediate lever means, said power operable means comprising a cylinder-piston system having a piston rod connected to said intermediate lever means, said intermediate lever means being linked to said levers supporting said abutment means, cshioning means and said cylinder-piston system comprising a double acting piston having its end positions defined by said cushioning means.

11. A device according to claim 10, in which said abutment means consist at least in part of shock-absorbing material.

12. A device according to claim 10, in which said abutment means are adjustably connected to said levers.

13. A device according to claim 10, in which said coupling head has a coupling surface, and which includes a pressure switch for preventing said cam means from being clamped between said abutment means when said device is in coupled condition.

14. A device according to claim 10, in which said cam means is in coaxial direction clamped in shock-absorbing material.

15. A device according to claim 10, in which said cam means has those areas thereof which are intended to engage said abutment means covered with shock-absorbing material.

* * * * *